United States Patent [19]

Jeschke et al.

[11] Patent Number: 4,843,966

[45] Date of Patent: Jul. 4, 1989

[54] INK DUCT WITH AN INK METERING DEVICE FOR OFFSET PRINTING AND LETTERPRESS MACHINES

[75] Inventors: Willi Jeschke, Heidelberg; Karl-Heinz Filsinger, Wiesloch, both of Fed. Rep. of Germany

[73] Assignee: Heidelberger Druckmaschinen AG, Heidelberg, Fed. Rep. of Germany

[21] Appl. No.: 235,782

[22] Filed: Aug. 22, 1988

Related U.S. Application Data

[63] Continuation of Ser. No. 75,148, Jul. 20, 1987, abandoned.

[30] Foreign Application Priority Data

Jul. 21, 1986 [DE] Fed. Rep. of Germany ..... 3624572

[51] Int. Cl.[4] ..... B41F 31/06; B41L 27/08

[52] U.S. Cl. ..... 101/363; 101/207

[58] Field of Search ..... 101/365, 350, 363, 364, 101/367, 204, 206–210

[56] References Cited

U.S. PATENT DOCUMENTS

| | | | |
|---|---|---|---|
| 236,566 | 1/1881 | Engels | 101/365 |
| 3,831,517 | 8/1974 | Wagner | 101/363 X |
| 4,481,883 | 11/1984 | Savart et al. | 101/365 X |

FOREIGN PATENT DOCUMENTS

| | | |
|---|---|---|
| 2411771 | 9/1974 | Fed. Rep. of Germany . |
| 2723845 | 11/1978 | Fed. Rep. of Germany . |
| 2928125 | 1/1981 | Fed. Rep. of Germany . |
| 1550715 | 8/1979 | United Kingdom . |
| 2145973 | 4/1985 | United Kingdom . |

*Primary Examiner*—J. Reed Fisher

*Attorney, Agent, or Firm*—Herbert L. Lerner; Laurence A. Greenberg

[57] ABSTRACT

Ink duct with an ink metering device for an offset printing or letterpress machine, the ink metering device being in cooperative engagement with a duct roller, includes an ink-duct side part pivotable about the axis of the duct roller and displaceable both perpendicularly and parallel to the duct roller, the ink-duct side part having an end face directed toward the duct roller and being in contact with the outer cylindrical surface of the duct roller, and the ink-duct side part having a lateral surface directed towards the interior of the ink duct and being in contact with a ductor knife in order to prevent ink from escaping from the ink-duct, and means for exerting a force on the ink-duct side part in order to maintain contact between the ink-duct side part and the duct roller.

8 Claims, 2 Drawing Sheets

Figure 1:
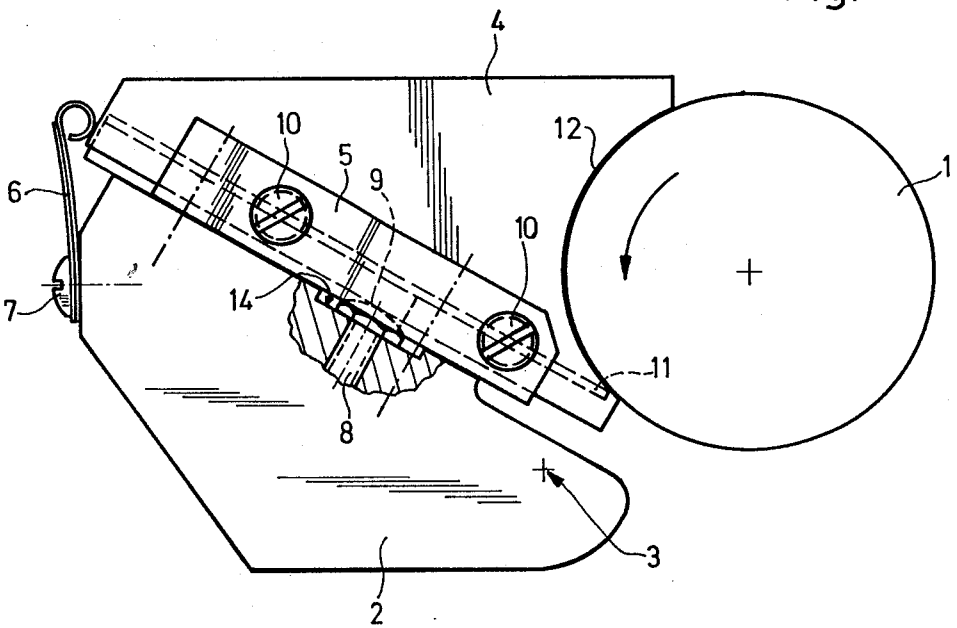

INK DUCT WITH AN INK METERING DEVICE FOR OFFSET PRINTING AND LETTERPRESS MACHINES

This application is a continuation, of application Ser. No. 075,148, filed July 30, 1987, now abandoned.

The invention relates to an ink duct with an ink metering device for offset printing or letterpress machines, the ink metering device cooperating with a duct roller.

Ink ducts are known in which side parts are bolted or pinned to the body of the ink duct.

The purpose of this measure is to prevent the undesired escape of ink into a joining region between a ductor knife and the respective ink duct side part.

The escape of the ink in the joining region between the side part and the duct roller is prevented in a conventional manner by having the side part in contact with an end face of the duct roller.

If a ductor knife which is too long is used, for example, ink will escape in the region of the end face of the duct roller, because the ink-duct side part, which is directly attached to the end of the ductor knife and thus directly dependent upon the latter, is unable to prevent the escape of ink because, due to the large free space between the end face of the duct roller and the ink-duct side part, the contact with the end face of the duct roller, which is necessary for sealing, is no longer assured.

In an opposite case, if the ductor knife is too short, the escape of ink in the region of the end of the duct roller is likewise unavoidable because, of necessity, there is a gap between the ink-duct side part and the ductor knife. It is also noted that, as a result of the ductor knife being too short, the ink-duct side part is pressed too strongly against the edge of the duct-roller surface and the duct-roller end face, which leads to damage (seizures).

In the same manner, these inadequacies occur if thermal expansion is not taken into consideration.

Furthermore, it is also known or conventional to provide the end face of the side part directed towards the duct roller with a recess corresponding to the surface curvature of the duct roller and to bring this end face into contact with the outer cylindrical surface of the duct roller.

This construction has proven to be disadvantageous in that swinging-away of the ink duct even by a very small angle from the duct roller leads to the escape of ink at the contact region between the end face of the ink-duct side part and the surface of the duct roller, because, as a result of the rigid connection of the ink-duct side part to the ink duct, the ink-duct side part is forcibly subjected to the swinging-away movement of the ink duct.

Accordingly, the possibility of effecting an overall inking adjustment by means of swinging the ink duct away is eliminated.

The heretofore known constructions therefore call for:

(a) high precision in the manufacture of parts, i.e. very small tolerances, (b) increased expense in the selection of materials, i.e. the thermal-expansion coefficients of the materials used must be taken into account when constructing the ink duct, (c) increased expense in assembling the ink duct, i.e. sorting of individual ink-duct components according to combinable tolerance ranges, and (d) concessions to the possibilities of adjustment, i.e. overall inking adjustment by swinging away the ink duct is possible only in the case of the construction wherein the ink-duct side parts are in contact with the end face of the duct roller.

It is accordingly an object of the invention to provide an ink duct with an ink metering device for offset printing and letterpress machines which achieves an optimization in the areas of adjustment possibility, sealing, and manufacturing and assembly costs, respectively.

With the foregoing and other objects in view there is provided, in accordance with the invention, an ink duct with an ink metering device for an offset printing or letterpress machine, the ink metering device being in cooperative engagement with a duct roller, comprising an ink-duct side part pivotable about the axis of the duct roller and displaceable both perpendicularly and parallel to the duct roller, the ink-duct side part having an end face directed towards the duct roller and being in contact with the outer cylindrical surface of the duct roller, and the ink-duct side part having a lateral surface directed towards the interior of the ink duct and being in contact with a ductor knife in order to prevent ink from escaping from the ink-duct, and means for exerting a force on the ink-duct side part in order to maintain contact between the ink-duct side part and the duct roller.

Advantages achievable with the invention, apart from in the enhanced sealing of the ink duct, are primarily that the manufacturing expense for the respective individual components is reduced and that the time for completely making the ink duct is likewise reduced, without any restrictions or limitations arising with respect to sealing ability. A further advantage results from the fact that the thermal-expansion coefficient can be virtually entirely disregarded, which gives rise to new perspectives with regard to the choice of materials. In addition, the invention permits relatively simple disassembly of the ink-duct side parts, which is of no little importance particularly when cleaning the ink duct. A further advantage is that, because the ink-duct side part is brought into contact by spring force, a slight swinging away of the ink duct is afforded in order to adjust the overall inking profile without creating any adverse effect upon the operation of the device.

In accordance with another feature of the invention, the end face of the ink-duct side part directed towards the duct roller is formed with a recess corresponding to the surface curvature of the duct roller, the recess having a base which is in contact with the outer cylindrical surface of the duct roller. The entire end face can thus be brought into contact with the duct roller, thereby preventing the ink from escaping over the entire height or level of the ink-duct side part.

To prevent friction between the end face of the ink-duct side part and the outer cylindrical surface of the duct roller, in accordance with a further feature of the invention, the end face of the ink-duct side part is formed of an oleophobic material such as a plastic material.

To maintain the contact between the ink-duct side part, the ductor knife and the duct roller, in accordance with added features of the invention, spring means, such as a leaf spring, are provided for subjecting the side part to a force directed towards the duct roller, that force being directed in particular to the region below the axis of the duct roller, as well as to a force directed to the ductor knife so as to prevent the ink from escaping.

In accordance with an additional feature of the invention, there is provided a guide element disposed in a region of an end of the ductor knife, the guide element defining a groove for holding and guiding the ink-duct side part, the groove extending perpendicularly to the ductor knife.

In accordance with yet another feature of the invention, the end of the ductor knife forms a side wall of the guide groove directed towards the interior of the ink duct.

In accordance with yet a further feature of the invention, there are provided spring means formed in an outer side of the guide elements for applying a force to the ink-duct side part so as to press an inner side of the ink-duct side part against the ductor knife.

In accordance with a concomitant feature of the invention, a bolt is screwed into a base of the guide groove, the bolt having a spherical head projecting beyond the base. With such a construction, the ink-duct side part is able to tilt about this seating or contact point.

Other features which are considered as characteristic for the invention are set forth in the appended claims.

Although the invention is illustrated and described herein as embodied in ink duct with an ink metering device for offset printing and letterpress machines, it is nevertheless not intended to be limited to the details shown, since various modifications and structural changes may be made therein without departing from the spirit of the invention and within the scope and range of equivalents of the claims.

Figure 2:
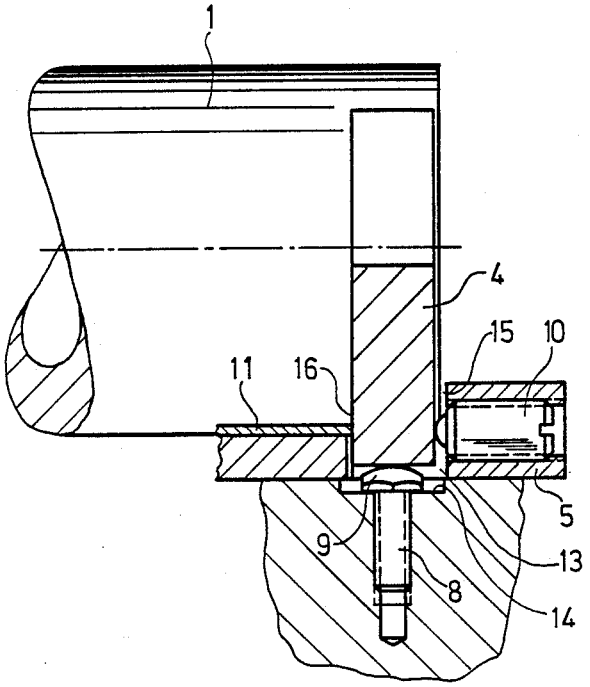

The construction and method of operation of the invention, however, together with additional objects and advantages thereof will be best understood from the following description of specific embodiments when read in connection with the accompanying drawing, in which:

FIG. 1 is a diagrammatic front elevational view of an ink duct with an ink metering device for offset printing and letterpress machines; and FIG. 2 is a side elevational view partly in section, of FIG. 1.

Referring now to the drawing and first, particularly, to FIG. 1 thereof, there is shown a duct roller 1 associated with an ink duct 2 which is arranged so as to be swivellable away from the duct roller 1 via a pivot point 3.

The ink duct 2 is bounded at each of the two end faces thereof by an ink-duct side part 4.

The end face 12, in turn, of the ink-duct side part 4 is provided with a recess corresponding to the surface curvature of the duct roller 1 and is formed with an anti-friction coating, thereby preventing escape of ink from the duct 2 in this contact region.

A spring 6, which is connected at one of its ends to the ink duct 2 by means of a screw 7, exerts upon the ink-duct side part 4 a force directed at a region below the axis of the duct roller 1, so that the end face 12 of the ink-duct side part 4 is pressed against the duct roller 1, thereby maintaining a seal between the surface of the duct roller 1 and the end face 12 of the ink-duct side part 4.

When the ink duct 2 is swung away slightly about the pivot points 3, for effecting an overall inking adjustment, no effect is produced upon the seal formed between the end face 12 of the side part 4 and the surface of the duct roller 1, because the ink-duct side part 4 continues to be subjected to the force of the spring 6 and remains in contact. The mobility of the ink-duct side part 4 requires for this purpose results from the ink-duct side part 4 being arranged so as to be movable with respect to the ink duct 2 and with respect to the duct roller 1. To achieve this mobility, a guiding groove 13 illustrated in FIG. 2 is provided, the guiding groove 13 adjoining a ductor knife 11 and serving to hold the ink-duct part 4.

At a side thereof directed towards the interior of the ink duct 2, the ink-duct side part 4 is flatly in contact with the ductor knife 11, thereby effectively sealing the ink duct 2 in this end region of the ink duct 2.

The guiding groove 13 is defined at the outside thereof by a guide jaw 5 in which two spring elements 10 disposed at the level of the ductor knife 11 are provided. These spring elements 10 exert a force on the ink-duct side part 4 so that the ink-duct side part 4 is pressed against the ductor knife 11.

The guiding groove 13 is wider than the ink-duct side part 4, so that the ink-duct side part 4 is received between the ductor knife 11 and guide jaw 5 with clearance or a space 15. This space 15 affords an extended tolerance range for the manufacture of the ductor knife 11 and the ink-duct side part 4 and ensures the mobility of the ink-duct side part 4 required for adjustment of the ink duct 2.

A bolt 8 is threadedly secured in a blind bore formed in a base of the ink duct 2 defining the guiding groove 13, an end of the bolt 8 projecting beyond the base and forming a single seating or bearing point 9 for the ink-duct side part 4, thereby assuring the mobility and tilting, respectively, of the ink-duct side part 4 about the seating or bearing point 9.

The ink-duct side part 4 rests securely on the seating or bearing point 9 due to the fact that the force produced by the spring element 6 acts upon the region below the axis of the duct roller 1, due to which a force resulting therefrom is directed to the seating or bearing point 9. Furthermore, friction existing between the end face 12 of the ink-duct side part 4 and the outer cylindrical surface of the duct roller 1 causes an intensification or amplification of the seating or bearing force at the seating or bearing point 9.

The slight swinging-away of the ink duct 2 about the pivot point 3 also simultaneously causes the ink-duct side part 4 to be swung away and readjusted in the opposite direction about the seating or bearing point 9, as a result of which the sealing required between the end face 12 and the surface of the duct roller 1 is maintained.

The aforementioned example represents merely one embodiment of the invention; it is also possible, in particular, to provide other, identically operating types of point bearings or supports. It would also be conceivable to form the seating or bearing surface of the ink-duct side part 4 locally as a point support or bearing, so that the ink-duct side part 4 rests only in this region on the base defining the guiding groove 13.

Likewise, instead of the springs 6, it is possible to use other contacting elements, i.e. one or two screws which act on the upper side of the ink-duct side part 4.

There is claimed:

1. Ink duct with an ink metering device for an offset printing or letter-press machine, said ink metering device being in cooperative engagement with a duct roller, comprising an ink-duct side part pivotable about the axis of the duct roller and displaceable both perpendicularly and parallel to the duct roller, said ink-duct side part having an end face directed towards the duct roller and being in contact with the outer cylindrical surface of the duct roller, and said ink-duct side part having a lateral surface directed towards the interior of the ink duct and being in contact with a ductor knife in order to prevent ink from escaping from the ink-duct, means for exerting a force on the ink-duct side part in order to maintain contact between said ink-duct side part and the duct roller, a guide element disposed in a region of an end of the ductor knife, said guide element defining a groove for holding and guiding said ink-duct side part, said groove extending perpendicularly to the ductor knife, and means to cause pivoting about the axis of the duct roller comprising a bolt screwed into a base of the guide groove, said bolt having a spherical head projecting beyond said base.

2. Ink duct with an ink metering device for an offset printing or letterpress machine, said ink metering device being in cooperative engagement with a duct roller, comprising an ink-duct side part pivotable about the axis of the duct roller and displaceable both perpendicularly and parallel to the duct roller, said ink-duct side part having an end face directed towards the duct roller and being in contact with the outer cylindrical surface of the duct roller, and said ink-duct side part having a lateral surface directed towards the interior of the ink duct and being in contact with a ductor knife in order to prevent ink from escaping from the ink-duct, means for exerting a force on the ink-duct side part in order to maintain contact between said ink-duct side part and the duct roller, a guide element disposed in a region of an end of the ductor knife, said guide element defining a groove for holding and guiding said ink-duct side part, said groove extending perpendicularly to the ductor knife, and means to cause pivoting about the axis of the duct roller comprising a substantially spherical projection extending from a base of the guide groove.

3. Ink duct according to claim 2, wherein said end face of said ink-duct side part directed towards the duct roller is formed with a recess corresponding to the surface curvature of the duct roller, said recess having a base which is in contact with the outer cylindrical surface of the duct roller.

4. Ink duct according to claim 3, wherein said end face of said ink-duct side part is provided with an anti-friction coating.

5. Ink duct according to claim 2, including spring means located on a side of the ink duct opposite the duct roller for applying a force to said ink-duct side part so as to press said ink-duct side part against the outer cylindrical surface of the duct roller.

6. Ink duct according to claim 5, wherein said spring means are formed as a leaf spring.

7. Ink duct according to claim 2, wherein said end of the ductor knife forms a side wall of the guide groove directed towards the interior of the ink duct.

8. Ink duct according to claim 2, including spring means formed in an outer side of said guide element for applying a force to said ink-duct side part so as to press an inner side of said ink-duct side part against the ductor knife.

* * * * *